US005926912A

United States Patent [19]

Claphan

[11] Patent Number: 5,926,912

[45] Date of Patent: Jul. 27, 1999

[54] ATTACHABLE HAND GRIP DEVICE AND GLOVE KIT

[76] Inventor: Beth Claphan, 1906 Von Antwerp, Grosse Pointe Wood, Mich. 48236

[21] Appl. No.: 08/989,103

[22] Filed: Dec. 11, 1997

[51] Int. Cl.[6] ..... A47B 95/02

[52] U.S. Cl. ..... 16/114 R; 16/110 R; 16/DIG. 12; 2/161.7

[58] Field of Search ..... 16/114 R, 116 R, 16/111 R, 116 A, 110 A, 114 A, 110 R, DIG. 12; 220/755, 753; 38/95; 294/25; 74/551.9; 482/49; 81/177.1, 900; 403/228, 225, 372; 30/322, 324, 340; 2/17, 21, 20, 161.7, 161.5, 161.1, 167

[56] References Cited

U.S. PATENT DOCUMENTS

| | | | |
|---|---|---|---|
| 2,701,379 | 2/1955 | Balistreri | 16/114 R |
| 2,809,846 | 10/1957 | Whiteford | 30/324 |
| 3,072,955 | 1/1963 | Mitchell | 16/114 R |
| 3,368,811 | 2/1968 | Finney | 273/72 |
| 3,981,043 | 9/1976 | Curry | 16/114 R |
| 4,051,553 | 10/1977 | Howard | 2/161.7 |
| 4,796,306 | 1/1989 | Mitchell | 2/161.7 |
| 4,941,232 | 7/1990 | Decker et al. | 16/111 R |
| 4,964,192 | 10/1990 | Marui | 16/111 R |
| 5,018,221 | 5/1991 | Romandetto | 2/161.7 |
| 5,028,050 | 7/1991 | Freyer | 273/183 |
| 5,063,613 | 11/1991 | Brown | 2/161.7 |
| 5,316,294 | 5/1994 | Turangan | 273/65 |
| 5,335,916 | 8/1994 | Nee | 273/346 |
| 5,348,360 | 9/1994 | Mencarelli et al. | 16/114 R |
| 5,475,895 | 12/1995 | Gain | 16/111 R |

*Primary Examiner*—Chuck Y. Mah
*Attorney, Agent, or Firm*—Joseph N. Breaux

[57] ABSTRACT

An attachable hand grip device and glove kit wherein the attachable hand grip device is removably attachable to a handle, such as, without limitation, kitchen utensils or other implements such as tools, for increasing the circumferential outer perimeter of the handle to significantly minimize the amount of bending of the knuckle joints of the hand when gripping the attachable hand grip device; and a glove having a plurality of finger contouring members which limit the bending of the finger knuckle joints when gripping the hand around the circumferential outer perimeter of the attachable hand grip device.

17 Claims, 3 Drawing Sheets

ATTACHABLE HAND GRIP DEVICE AND GLOVE KIT

TECHNICAL FIELD

The present invention relates to attachable hand grip devices and gloves and, more particularly, to an attachable hand grip device and glove kit wherein the attachable hand grip device is removably attachable to a handle, such as, without limitation, kitchen utensils or other implements such as tools, for significantly increasing the circumferential outer perimeter of the handle to significantly minimize amount of bending of the joints of the hand when gripping the attachable hand grip device; and, a glove having a plurality of finger contouring members which limit the bending of the finger joints when gripping the hand around the circumferential outer perimeter of the attachable hand grip device or other handles.

BACKGROUND OF THE INVENTION

Sufferers of arthritis, multiple sclerosis, carpel tunnel, multiple sclerosis etc. often suffer pain and/or cramping when gripping household utensils, kitchen utensils, and other implements such as, tools, having an elongated handle as the joints of the fingers are bent around the contour of the elongated narrow handle.

Several devices have been patented which are aimed at covers for handles and/or gloves.

U.S. Pat. No. 5,475,895, by Gain, entitled "TOOL HAND GRIP" discloses a ring shaped hand grip having a smooth central bore. The outside diameter is substantially greater than the diameter of the central bore. The ring frictionally engages with a tool shank wherein the user may grasp the outside if the hand grip U.S. Pat. No. 4,964,192, by Marui, entitled "MULTIPLE RADIUS GRIP" discloses a cushioned grip having a unitary tubular-shaped body portion with an asymmetrical off-center cross-sectional shape. The center of the unitary tubular-shaped body portion has a circular central opening.

U.S. Pat. No. 4,941,232, by Decker et al., entitled "SLIP RESISTANT, CUSHIONING COVER FOR HANDLES" discloses a slip-resistant, flexible cushioning wrap for a handle. The wrap has a hollow circular interior which conforms to a cylindrical handle.

U.S. Pat. No. 5,335,916, by Nee, entitled "FINGERLESS PALM GLOVE" discloses a fingerless glove for use in a game of catch.

U.S. Pat. No. 5,316,294, by Turangan, entitled "GLOVE AND BALL FACILITATING A GAME OF CATCH" discloses a glove and ball useable together to play a game of catch.

U.S. Pat. No. 5,028,050, by Freyer, entitled "GOLFER'S GRIP TRAINING DEVICE" discloses a glove for training and improving the right golf grip.

U.S. Pat. No. 3,368,811, by Finney, entitled "INTER-LOCKING GLOVE AND HANDLE" discloses a glove useable with a hooking elements attached to a handle of a sporting implement. The glove has a patch which secures to the hooking elements attached to the handle.

While each of the above handle grips and/or gloves function as desired, none of them provide an attachable hand grip device and glove kit wherein the attachable hand grip device is removably attachable to a handle, such as, without limitation, kitchen utensils or other implements such as tools, for significantly increasing the circumferential outer perimeter of the handle to significantly minimize amount of bending of the joints of the hand when gripping the attachable hand grip device; and, a glove having a plurality of finger contouring members which limit the bending of the finger joints when gripping the hand around the circumferential outer perimeter of the attachable hand grip device or other handles.

SUMMARY OF THE INVENTIONS

The preferred embodiment of the an attachable hand grip device and glove kit of the present invention solves the aforementioned problems in a straight forward and simple manner. What is provided is an attachable hand grip device and glove kit wherein the attachable hand grip device is removably attachable to a handle, such as, without limitation, kitchen utensils or other implements such as tools, for increasing the circumferential outer perimeter of the handle to significantly minimize the amount of bending of the joints of the hand when gripping the attachable hand grip device; and a glove having a plurality of finger contouring members which limit the bending of the finger joints when gripping the hand around the circumferential outer perimeter of the attachable hand grip device and other handles, such as, without limitation scissorlike handles.

More specifically, then attachable hand grip and glove kit for use with household utensils or other implements having handles, of the present invention, comprises: an attachable hand grip device removably attachable to a handle of a household utensil or other implements wherein an outer perimeter of said attachable hand grip device significantly increases a outer perimeter of said handle to significantly minimize the amount of bending of the joints of fingers of a hand when gripping the attachable hand grip device; and, at least one glove couplable to at least one hand having a plurality of finger receiving channels each having coupled thereto a respective one of a plurality of finger contouring members wherein the plurality of finger contouring members limit the bending of the finger joints when coupling scissor-like handles to the fingers or when gripping the at least one hand around the outer perimeter of the attachable hand grip device or other handles.

In view of the above, an object of the present invention is to provide an attachable hand grip device and glove kit comprising an attachable hand grip device which is removably attachable to a myriad of handle profiles wherein a hollow interior channel resiliently adapts to such handle profiles.

Another object of the present invention is to provide an attachable hand grip device and glove kit comprising an attachable hand grip device and glove which can be used together or separately, as needed.

A further object of the present invention is to provide an attachable hand grip device and glove kit which serves to minimize pain and/or cramping experienced by sufferers of arthritis, multiple sclerosis, carpel tunnel, and other conditions which cause pain and/or cramping of the hand and/or fingers when gripping a handle.

It is a still further object of the present invention to provide an attachable hand grip device and glove kit comprising an attachable hand grip device which is relatively lightweight.

It is a still further object of the present invention to provide a glove with finger contouring members curved to conform the fingers of the hand to the curvature of the other perimeter of the attachable hand grip. Thereby, the repeated bending and flexing is minimized to minimize pain and cramping.

It is a still further object of the present invention to provide the attachable hand grip device with a resilient hollow inner conduit having a circular cross-sectional profile wherein a plurality of spaced slits radially project therefrom.

In view of the above objects, it is a feature of the present invention to provide an attachable hand grip device and glove kit which is simple and inexpensive to manufacture.

Another feature of the present invention is to provide an attachable hand grip device and glove kit which is simple to use.

The above and other objects and features of the present invention will become apparent from the drawings, the description given herein, and the appended claims.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
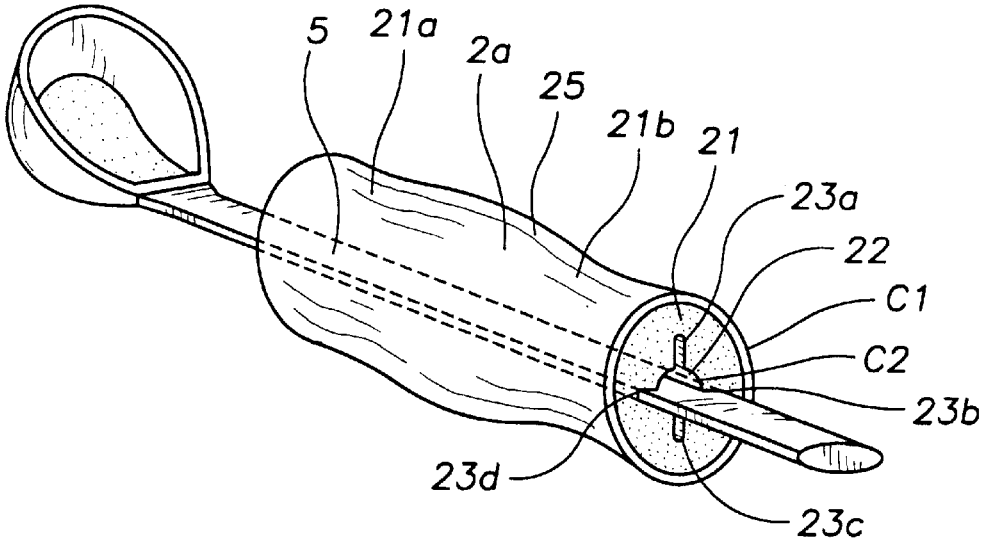
FIG. 1 illustrates a perspective view of the preferred embodiment of the attachable hand grip device of the present invention coupled to a handle of a household utensil.
Figure 2:
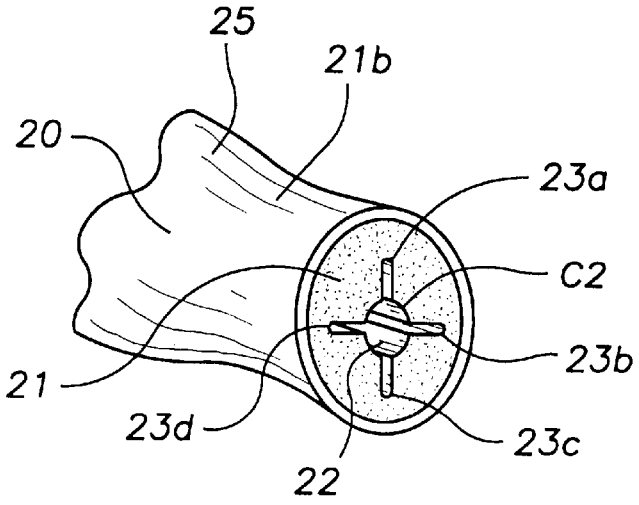
FIG. 2 illustrates an end view of the attachable hand grip device of the present invention shown in FIG. 1.
Figure 3:
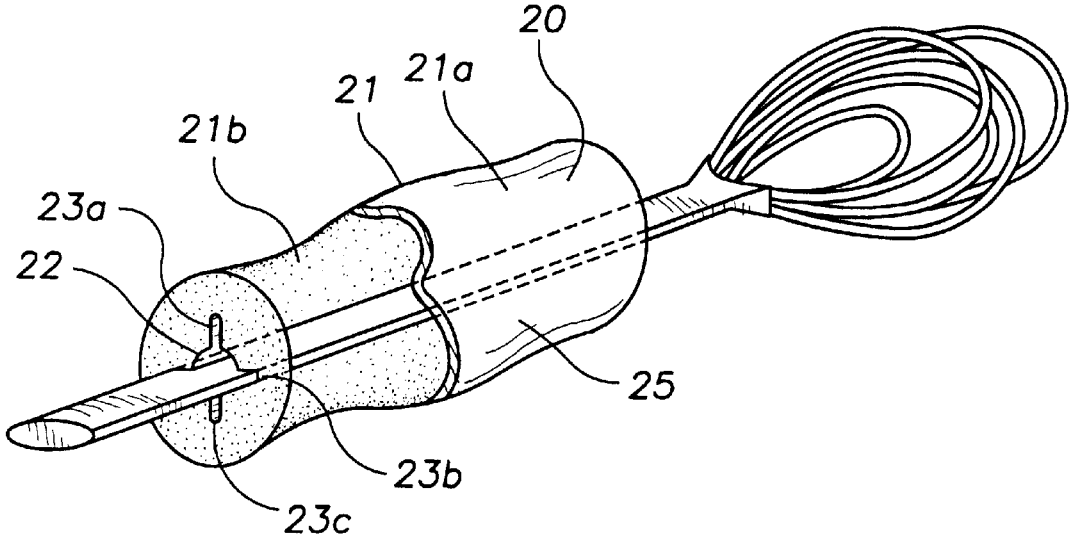
FIG. 3 illustrates a perspective view of the preferred embodiment of the attachable hand grip device of the present invention with the outer covering partially removed.
Figure 4:
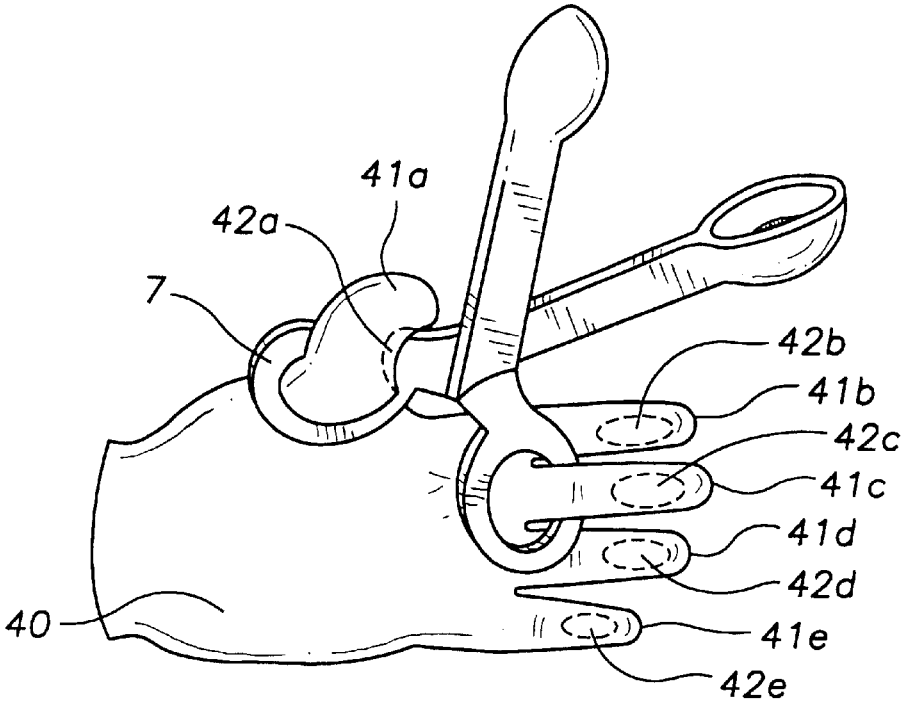
FIG. 4 illustrates a perspective view of the preferred embodiment of the glove of the present invention coupled to a scissor-type handle of a household utensil.
Figure 5:
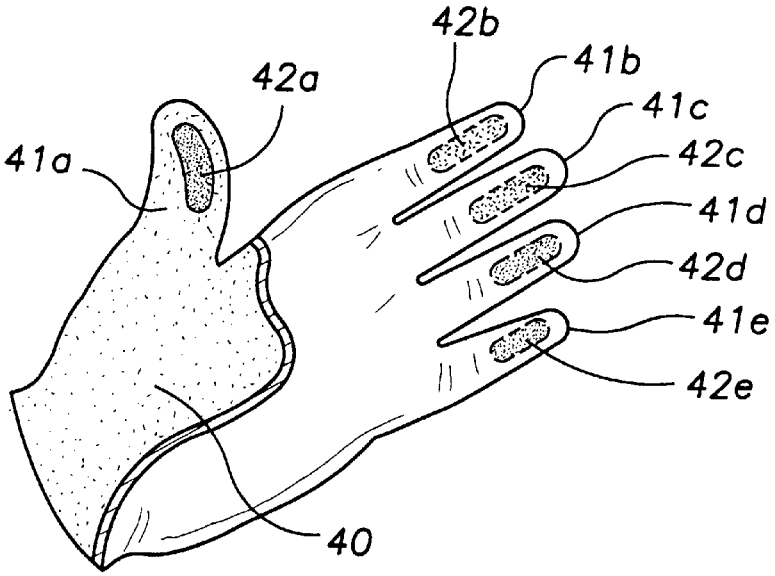
FIG. 5 illustrates a palm view of the preferred embodiment of the glove of the present invention illustrating the finger contouring members and having a portion of the palm of the glove removed; and, FIG. 6 illustrates a side view of the preferred embodiment of the glove of the present invention.
Figure 6:
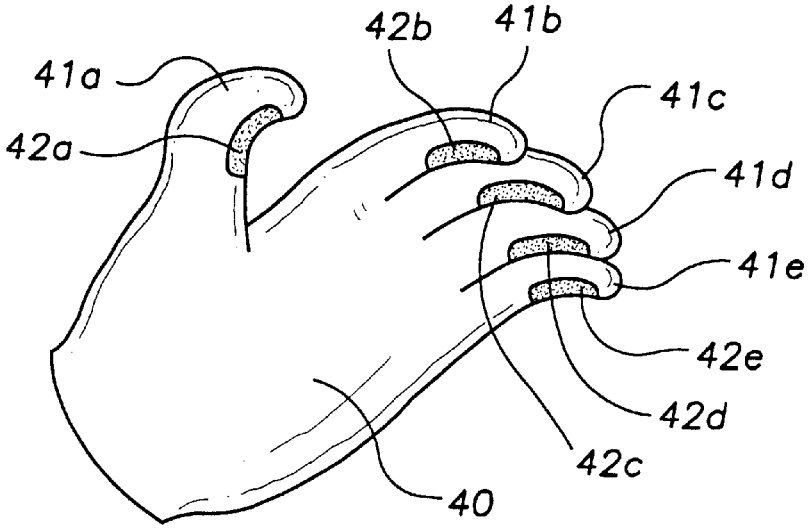

Referring now to the drawings, and in particular FIGS. 1–6, the attachable hand grip and glove kit of the present invention is comprised of attachable hand grip device 20 and glove 40.

Attachable hand grip device 20 comprises resilient cylindrical member 21 having outer circumference C1 having formed therein hollow inner conduit 22 having circumference C2 wherein outer circumference C1 is much larger than circumference C2. Hollow interior conduit 22 has a circular cross-sectional profile. Extending radially from hollow interior conduit 22 are a plurality of spaced slits 23*a*, 23*b*, 23*c*, and 23*d* formed in cylindrical member 21. The circumference C2 of hollow inner conduit 22 provides a narrow opening for journalling handle member 5 of a household utensil or other implements such as, tools. The plurality of spaced slits 23*a*, 23*b*, 23*c* and 23*d* radially extend from hollow interior conduit 22 serve to allow cylindrical member 21 to expand to the dimensions of the outer perimeter of a myriad of handle members. For example, hollow interior conduit 22 is capable of receiving therein circular handles. The plurality of spaced slits 23*a*, 23*b*, 23*c* and 23*d* serve to adapt hollow interior conduit 22 so that a more flat handle may be received therein.

Resilient cylindrical member 21 is made of a lightweight, elastometric material, such as polyethylene foamed plastic, other foamed plastic material, rubber, or neoprene. For example, foamed plastic having a closed-cell or open-cell structure. The foamed plastic is highly pliable and resilient whereby as the handle of the household utensil is journalled through hollow interior conduit 22, hollow interior conduit flexes to the outer perimeter contour of a myriad of handle outer perimeter contours. The resilient properties allows the hollow interior conduit 22 to collapse around the contour of the handles' outer perimeter to maintain a sufficiently tight fit therearound. The resilient properties of foamed plastic further allows the handle member 5 journalled therethrough hollow interior conduit 22 to be easily withdraw therefrom and removed without significantly stretching hollow interior conduit 22.

Cylindrical member 21 is covered with jacket 25 which conforms to the outer perimeter of cylindrical member 21. In the preferred embodiment jacket 25 may be neoprene or any of plastic or rubber material which can be easily cleaned. Thereby, jacket 25 can be easily wiped off or washed to clean attachable hand grip 20 after cooking. In the preferred embodiment, cylindrical member 21 has formed therein first and second circumferential indentations 21*a* and 21*b* to enhance the gripping of the hand around attachable hand grip 20. Furthermore, a plurality of indentations may be provides to conform to the fingers of the gripping hand.

Glove 40 comprises an enclosure which encloses the hand having five finger channels 41*a*, 41*b*, 41*c*, 41*d* and 41*e*. Each finger channel has coupled thereto a respective one of a plurality of finger contouring members 42*a*, 42*b*, 42*c*, 42*d* and 42*e*. Each finger contouring member of the plurality of finger contouring members 42*a*, 42*b*, 42*c*, 42*d* and 42*e* is curved inwardly so that at least the top knuckle of the fingers of the user are maintained in a curve position when the hand of the user is fully received in glove 40. Each finger contouring member of the plurality of finger contouring members 42*a*, 42*b*, 42*c*, 42*d* and 42*e* may have a curved arch which limits the bending of two joints of each finger. The finger contouring members 42*a*, 42*b*, 42*c*, 42*d* and 42*e* minimize the repeated bending and flexing along the joints of the fingers thereby minimizing, if not, eliminating pain and cramping of the hands and fingers of arthritis, multiple sclerosis, and carpel tunnel sufferers.

Preferably, the curvature of finger contouring members 42*a*, 42*b*, 42*c*, 42*d* and 42*e* conforms the fingers of the hand to the curvature of the other perimeter of attachable hand grip 20. Thereby, the repeated bending and flexing is minimized to minimize pain and cramping when gripping attachable hand grip 20. In the preferred embodiment, finger contouring members 42*a*, 42*b*, 42*c*, 42*d* and 42*e* are made of aluminum. Nevertheless, other material may be substituted provided the finger contouring members 42*a*, 42*b*, 42*c*, 42*d* and 42*e* maintain their curvature.

Glove 40 and attachable hand grip device 20 may be used together or separately as desired by the user. Preferably, glove 40 is useable with household utensils with scissor-like handles 7 or other gripping handles. Furthermore, glove 40 may be used to control the bending and flexing along the joints of the fingers when the user grips the attachable hand grip device 20 having journalled therethrough a handle member of a household utensil.

While the preferred embodiment is designed to adapt to An household utensils, the attachable hand grip 20 may be made smaller to couple to a writing tool or a toothbrush.

The exemplary embodiment illustrates a left hand glove for use by a left handed user. Nevertheless, glove 40 may be a right hand glove for right handed users. Furthermore, the attachable hand grip device and glove kit may be provided with a right and left hand glove.

It is noted that the embodiment of the attachable hand grip device and glove kit described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An attachable hand grip and glove kit for use with household utensils or other implements having handles comprising:

an attachable hand grip device removably attachable to a handle of a household utensil or other implements wherein an outer perimeter of said attachable hand grip device significantly increases a outer perimeter of said handle to significantly minimize the amount of bending of the joints of fingers of a hand when gripping the attachable hand grip device; and a glove couplable to the hand having a plurality of finger receiving channels each having coupled thereto a respective one of a plurality of finger contouring members wherein the plurality of finger contouring members limit the bending of the finger joints when gripping the hand around the outer perimeter of the attachable hand grip device.

2. The kit of claim 1, wherein a curvature of the plurality of finger contouring members conforms the fingers of the at least one hand to a curvature of a perimeter of said attachable hand grip device.

3. The kit of claim 1, wherein the attachable hand grip device is a lightweight cylindrical member having outer circumference and having formed therein a hollow inner conduit having a circumference wherein said outer circumference is much larger than said circumference of said hollow inner conduit and wherein said hollow inner conduit has extending radially therefrom a plurality of spaced slits formed in said cylindrical member.

4. The kit of claim 3, wherein the cylindrical member is made of resilient material wherein the resilient material allows hollow inner conduit and the plurality of spaced slits to adapt to different handle profiles.

5. The kit of claim 4, wherein the resilient material cushions the grip of the hand when the attachable hand grip device is gripped.

6. The kit of claim 3, wherein the cylindrical member has formed therein first and second circumferential indentations.

7. An attachable hand grip and glove kit for use with household utensils or other implements having handles comprising:

an attachable hand grip device removably attachable to a handle of a household utensil or other implements wherein an outer perimeter of said attachable hand grip device significantly increases a outer perimeter of said handle to significantly minimize the amount of bending of the joints of fingers of a hand when gripping the attachable hand grip device; and at least one glove couplable to at least one hand having a plurality of finger receiving channels each having coupled thereto a respective one of a plurality of finger contouring members wherein the plurality of finger contouring members limit the bending of the finger joints when coupling scissor-like handles to the fingers or when gripping the at least one hand around the outer perimeter of the attachable hand grip device or other handles.

8. The kit of claim 7, wherein a curvature of the plurality of finger contouring members conforms the fingers of the at least one hand to a curvature of a perimeter of said attachable hand grip device.

9. The kit of claim 7, wherein the attachable hand grip device is a lightweight cylindrical member having outer circumference and having formed therein a hollow inner conduit having a circumference wherein said outer circumference is much larger than said circumference of said hollow inner conduit and wherein said hollow inner conduit has extending radially therefrom a plurality of spaced slits formed in said cylindrical member.

10. The kit of claim 9, wherein the cylindrical member is made of resilient material wherein the resilient material allows hollow inner conduit and the plurality of spaced slits to adapt to different handle profiles.

11. The kit of claim 10, wherein the resilient material cushions the grip of the hand when the attachable hand grip device is gripped.

12. The kit of claim 9, wherein the cylindrical member has formed therein first and second circumferential indentations.

13. An attachable hand grip and glove kit for use with household utensils or other implements having handles comprising:

an attachable hand grip device removably attachable to a handle of a household utensil or other implements wherein an outer perimeter of said attachable hand grip device significantly increases a outer perimeter of said handle to significantly minimize the amount of bending of the joints of fingers of a hand when gripping the attachable hand grip device wherein the attachable hand grip device comprises: a lightweight cylindrical member having outer circumference and having formed therein a hollow inner conduit having a circumference wherein said outer circumference is much larger than said circumference of said hollow inner conduit and wherein said hollow inner conduit has extending radially therefrom a plurality of spaced slits formed in said cylindrical member; and at least one glove couplable to at least one hand having a plurality of finger receiving channels each having coupled thereto a respective one of a plurality of finger contouring members wherein the plurality of finger contouring members limit the bending of the finger joints when coupling scissor-like handles to the fingers or when gripping the at least one hand around the outer perimeter of the attachable hand grip device or other handles.

14. The kit of claim 13, wherein a curvature of the plurality of finger contouring members conforms the fingers of the at least one hand to a curvature of a perimeter of said attachable hand grip device.

15. The kit of claim 13, wherein the cylindrical member is made of resilient material wherein the resilient material allows hollow inner conduit and the plurality of spaced slits to adapt to different handle profiles.

16. The kit of claim 15, wherein the resilient material cushions the grip of the hand when the attachable hand grip device is gripped.

17. The kit of claim 13, wherein the cylindrical member has formed therein first and second circumferential indentations.

* * * * *